US007231721B2

(12) United States Patent
Minica et al.

(10) Patent No.: US 7,231,721 B2
(45) Date of Patent: Jun. 19, 2007

(54) ARCHERY LASER ARROW

(76) Inventors: Stuart Minica, 414 Hidden Deer, La Vermia, TX (US) 78121; John Martin Taboada, 12718 Cranes Mill, San Antonio, TX (US) 78230

( * ) Notice: Subject to any disclaimer, the term of this patent is extended or adjusted under 35 U.S.C. 154(b) by 0 days.

(21) Appl. No.: 10/870,590

(22) Filed: Jun. 17, 2004

(65) Prior Publication Data

US 2005/0278964 A1 Dec. 22, 2005

(51) Int. Cl.
*F41G 3/26* (2006.01)
*F41G 1/54* (2006.01)

(52) U.S. Cl. ..... 33/265; 33/286; 33/293; 124/87

(58) Field of Classification Search ..... 33/265, 33/286, DIG. 21, 290–293, 506; 124/87
See application file for complete search history.

(56) References Cited

U.S. PATENT DOCUMENTS 3,641,675 A * 2/1972 Funk, Jr. ..... 33/265
RE32,123 E * 4/1986 Knight ..... 434/1
5,175,651 A * 12/1992 Marron et al. ..... 359/721
5,419,050 A * 5/1995 Moore ..... 33/DIG. 21
5,634,278 A * 6/1997 London ..... 33/265
6,005,719 A * 12/1999 Rando ..... 33/286
6,040,566 A * 3/2000 Rioland et al. ..... 356/121
6,134,793 A * 10/2000 Sauers ..... 33/265
6,366,344 B1 * 4/2002 Lach ..... 33/265
6,490,060 B1 * 12/2002 Tai et al. ..... 33/333
6,526,666 B1 * 3/2003 Lastinger, Jr. ..... 33/265
6,622,392 B1 * 9/2003 Bourget ..... 33/293
6,851,197 B2 * 2/2005 Terry et al. ..... 33/265
6,997,716 B2 * 2/2006 Skala et al. ..... 434/21
2002/0197584 A1 * 12/2002 Kendir et al. ..... 434/21
2004/0014010 A1 * 1/2004 Swensen et al. ..... 434/21

* cited by examiner

*Primary Examiner*—Yaritza Guadalupe-McCall
(74) *Attorney, Agent, or Firm*—John Martin Taboada

(57) ABSTRACT

The laser targeting system of the present invention eliminates the problem of parallax between the arrow's path and the archer's line of sight. An embodiment is a laser integrated into an arrow such that the beam is projected down the axis of the arrow. Another embodiment is an arrow rest with an integrated laser, which can have an angular adjustment. By having the laser extend the axis of the arrow to the target, the laser spot produced on the target accurately represents where the arrow will hit once released, and eliminates the parallax angle between the archer's line of sight and the arrow's path. The present invention also provides a means for using a single laser beam to project a diffractive pattern onto a target, such as several spots or crosshairs. For advanced visibility of the laser spot, an optical filter or infrared vision optical sensors can be used.

6 Claims, 4 Drawing Sheets

ARCHERY LASER ARROW

BACKGROUND OF THE INVENTION

1. Field of the Invention

The present invention relates to archery equipment, particularly to the method and apparatus for aiming with lasers and enhanced laser sighting with optical filters and imaging devices.

2. Description of the Related Art

Lasers have been used on archery equipment for aiming, but they all suffer from the problem of parallax. Currently, there are no functional lasers that are mounted on or near to the arrow, such as arrows, arrowheads, or arrow rests with integrated lasers. Lasers at visible wavelengths and other parts of the electromagnetic spectrum may be used, such as in the infrared. Additionally, there are no sights that allow for the enhanced visibility of the laser spot by utilizing optical filters or imaging devices.

U.S. Pat. No. 6,134,793, issued on Oct. 24, 2000 to James C. Sauers, describes a laser attached to an arrow used only for alignment of a bow sight and not while aiming, and is not capable of being shot from the bow as a projectile. The laser as used in this prior art patent is temporarily mounted to an arrow in place of the arrowhead. This prior art does not describe the capability of holding an arrowhead and the laser at the same time.

SUMMARY OF THE INVENTION

The laser targeting system of the present invention eliminates the problem of parallax, which is the angle between the arrow's path and the archer's line of sight. A novel solution as in the present invention is accomplished by having a laser integrated into the arrow or arrowhead such that the beam is projected down the axis of the arrow. Still another novel solution is to have an arrow rest with an integrated laser. By having the laser extend the axis of the arrow to the target, the laser spot produced on the target accurately represents where the arrow will hit once released, and eliminates the parallax angle between the archer's line of sight and the arrow's path. This behavior occurs in the flat-trajectory range of any given bow, rest, and arrow setup. The flat-trajectory range is typically 20 to 30 yards depending on the age and technology of the bow, tuning of the bow, weight and spine of the arrow, and amount of friction and interference the arrow rest causes. It is estimated that 90% of shots taken while bow hunting are within 30 yards so the present invention covers a majority of bow hunting opportunities. Any time one is targeting beyond the flat-trajectory range of a bow setup, the archer will have to adjust accordingly for the distance. For such targets beyond the flat-trajectory range, the archer would have to aim the laser dot higher on the target to account for arrow drop of the setup. This is very similar to archers who only use one sight pin in their sights. This archer has the single sight pin set for the longest distance before the arrow starts to drop. When shooting beyond this distance the archer simply raises the bow until the sight pin is higher on the target, thus accounting for arrow drop.

The present invention also provides a means for using a laser beam to project a diffractive pattern onto a target, such as several spots or crosshairs. A diffractive element can generate this diffractive pattern from a laser beam. The pattern can be used as aiming reference points to adjust for arrow drop at various distances, much like multiple sights pins in a typical archery sight.

The laser targeting system of the present invention offers many improvements over conventional sighting systems, even those that use lasers, because they all suffer from the problem of parallax. With the present invention, typical sights are not necessary because the laser beam extends the axis of the arrow and visually shows where the arrow will hit on the target. Additionally, the time consuming procedures of initial setup and maintenance of typical sights and the risk of having sights inadvertently bumped out of alignment are eliminated. The need to have a consistent anchor point when drawing and releasing the bow is also no longer necessary, which eliminates the need for common peep sights, kisser buttons, and other accessories used to draw the bow back to a consistent anchor point. By eliminating parallax and the need for a consistent anchor point, the present invention improves the ability to aim the bow accurately, even from awkward positions commonly encountered during bow hunting. For example, even an ill-advised "from the hip" shot will be an accurately placed shot with the present invention. The laser targeting system of the present invention also offers a unique method to check for obstructions in the arrow's flight path. Because the laser beam is projected down the arrow path, if the flight path is obstructed it will be obvious to the archer because the laser beam will project on the obstruction and will not be visible on the target.

The laser spot projected onto the target is visually enhanced by the use of an optically filtered sight or imaging device. An optical filter enhances the visibility of the laser on the target and allows for the use of a lower power laser while still being able to effectively see the spot on the target. A lower power laser is smaller and lighter-weight, thus minimizing the affect on arrow flight. Still another sighting approach can be obtained by using near-infrared lasers and night vision viewing means filtered to enhance the IR laser beam.

The laser integrated into the arrow rest may also be made adjustable to allow for different angles of the laser beam relative to the arrow trajectory. This adjustment allows the archer to set the laser depending on the distance to the target.

Still further features and advantages will become apparent from the ensuing description and drawings.

DETAILED DESCRIPTION OF THE PREFERRED EMBODIMENTS

Figure 1:
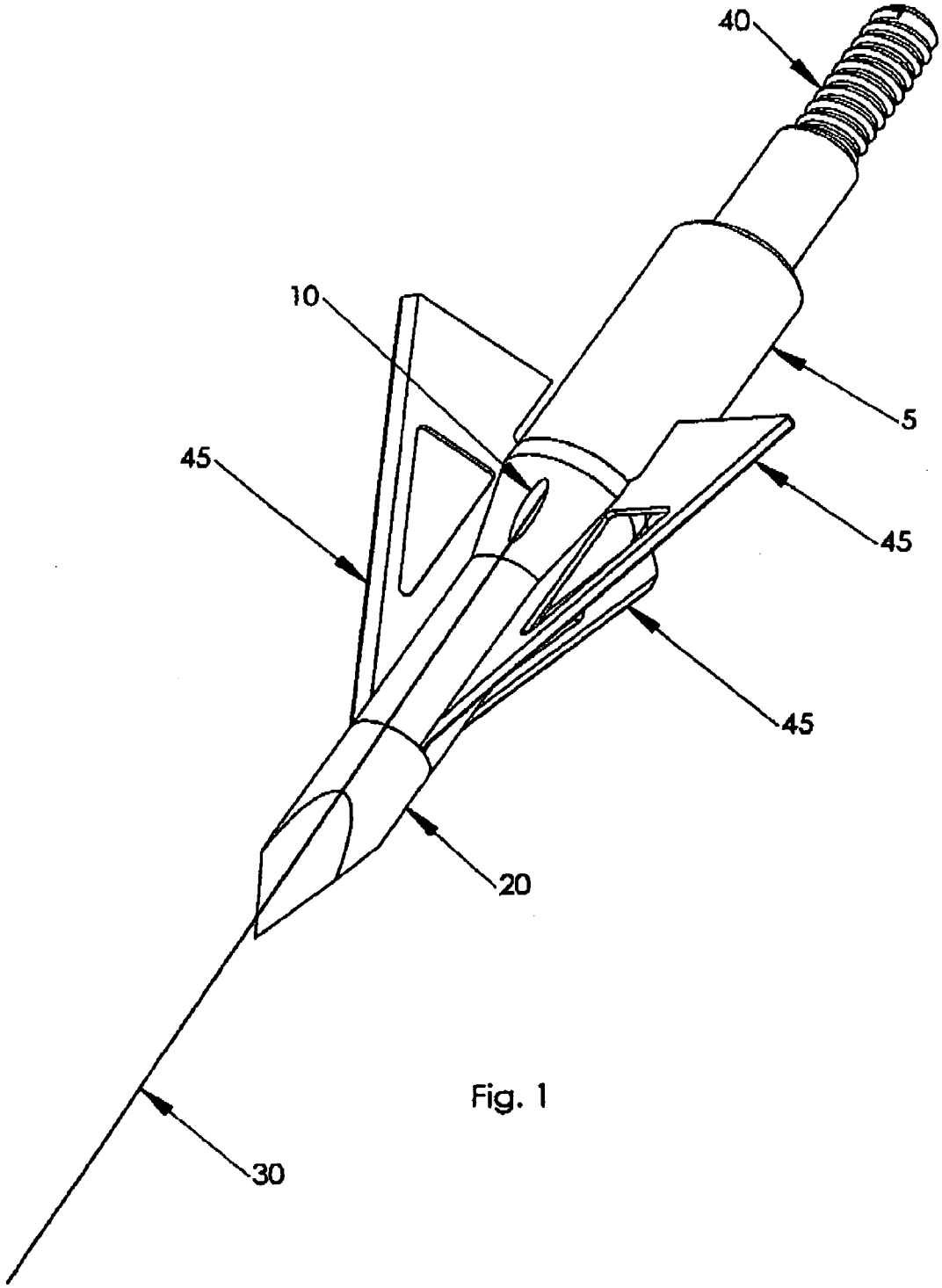
FIG. 1 is a perspective view of an arrowhead with an integrated laser showing the laser beam exiting the aperture.

Referring to FIG. 1, an arrowhead comprises an elongated body (5) having a first end (20) and an aperture (10) through which a laser beam (30) projects. The aperture may comprise a glass window or some other transparent media that allows the laser beam to emanate unobstructed from the arrowhead. The arrowhead also comprises a threaded end (40) for attaching to different arrows and one or more blades (45) for hunting. The laser is integrated into the arrowhead such that the laser beam projects through the aperture in a parallel and substantially coaxial relationship with the arrow.

Figure 2:
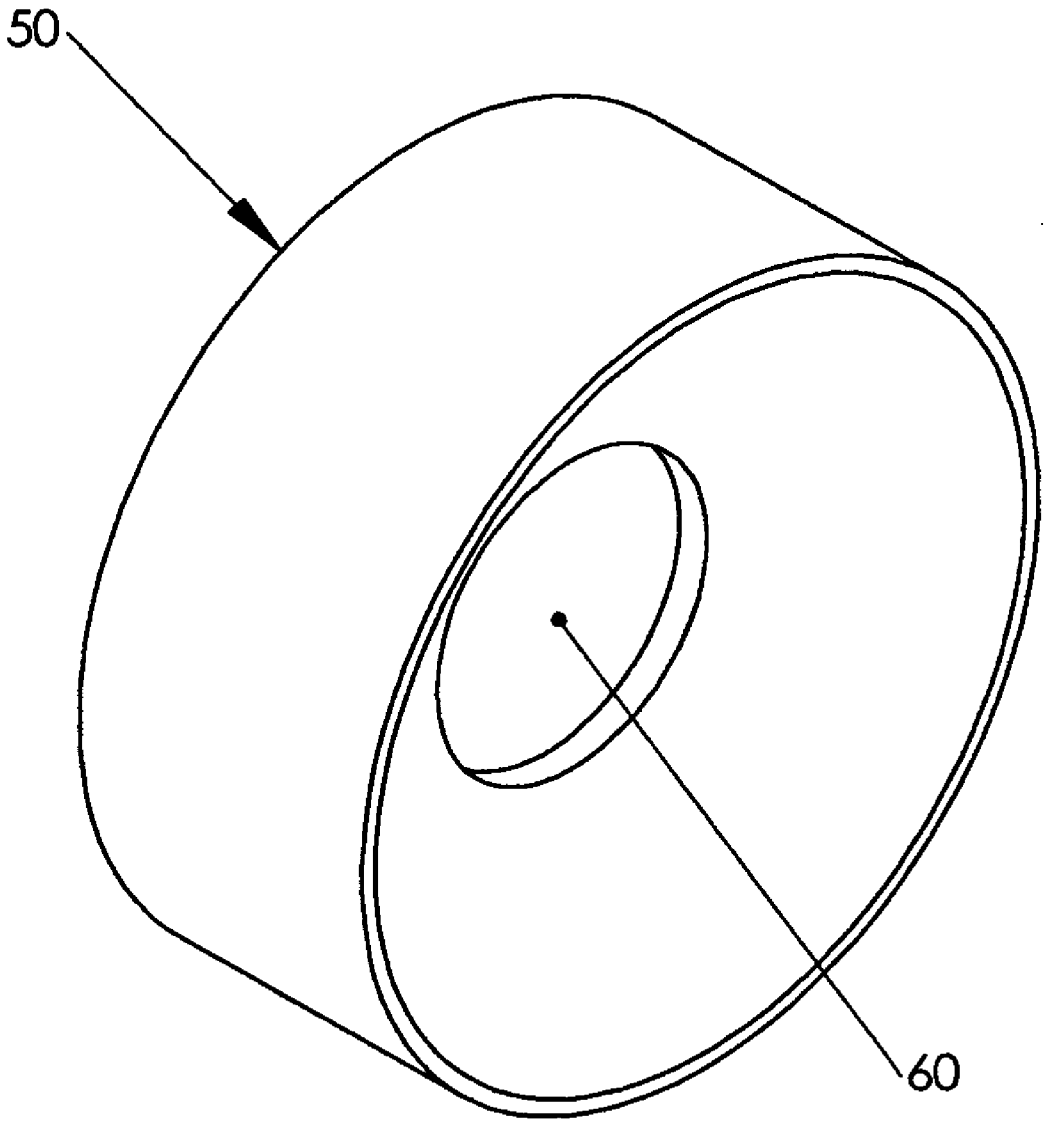
FIG. 2 is a perspective view of an optically filtered sight.

Referring to FIG. 2, a sight (50) fabricated with an optical filter in the aperture (60) visually enhances the laser spot produced on the target. The current embodiment consists of a laser having a wavelength of 650 nm and thus a corresponding sight consisting of a filter that blocks most of the other visible wavelengths except those around 650 nm. The sight filter is designed to pass the wavelength of the laser. Other wavelength lasers may be used with corresponding filters and image sensors.

Figure 3:
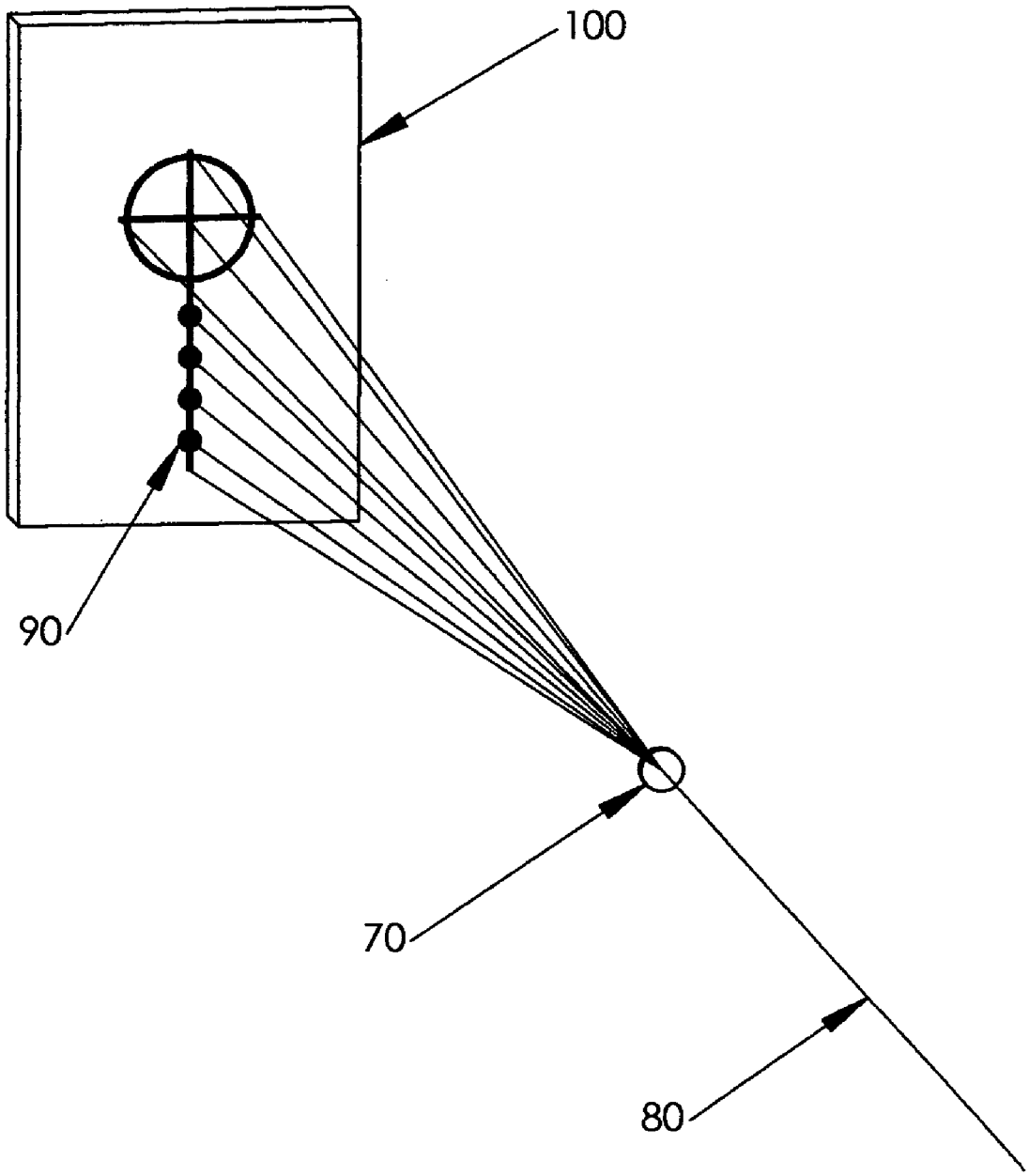
FIG. 3 is a perspective view of a diffractive element intercepting a laser beam resulting in a diffraction pattern on a target.

Referring to FIG. 3, a diffractive element (70) intercepts the laser beam (80). The diffractive element causes a pattern (90) to be projected on the target (100). The pattern is used to assist in aiming, especially for targets beyond the flat-trajectory range.

Figure 4:
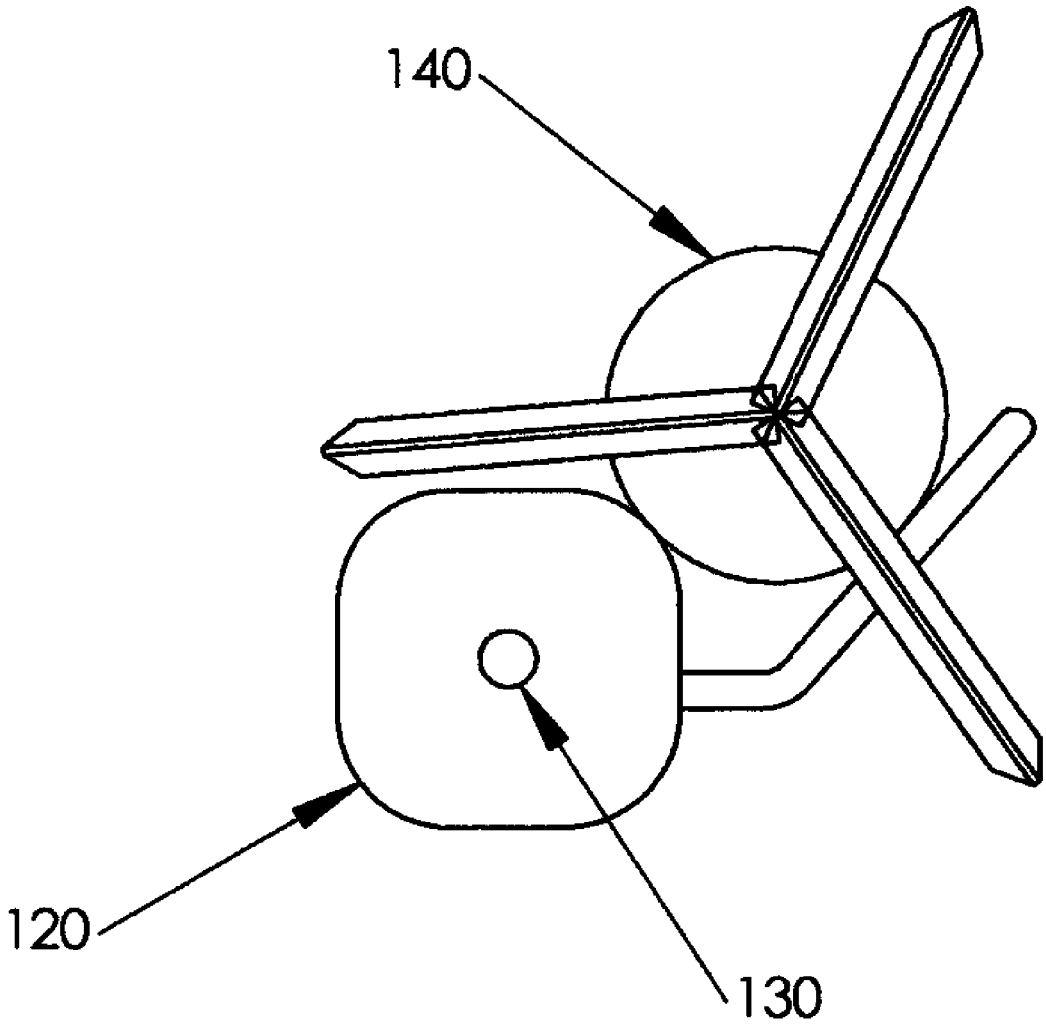
FIG. 4 is a front view of a laser integrated with an arrow rest.

Referring to FIG. 4, a laser is integrated with an arrow rest (120) such that the laser beam (130) is parallel to the axis of the arrow (140). Since the laser is within close proximity to the arrow, this arrangement does not suffer from a parallax problem.

It is to be understood that the present invention is not limited to the embodiments described above, but encompasses any and all embodiments within the scope of the following claims.

The invention claimed is:

1. A method for eliminating aiming parallax during hunting comprising:

a. providing a bow, b. providing an arrow mounted onto the bow, c. providing an arrow tip having a bladed first end and attached to the arrow at a second end, d. providing a laser integrated into the arrow tip such that a laser beam is emitted through an aperture at the first end of the arrow tip and is substantially coaxial with the arrow, e. whereby the laser, the arrow tip, and arrow are to be shot from the bow.

2. The method of claim 1 wherein the aperture comprises an optically transparent window.

3. The method of claim 1 wherein the laser beam passes through a diffractive element integrated into the arrow tip before being emitted from the arrow tip.

4. An archery projectile for hunting comprising:

a. an arrow, b. an arrow tip having a bladed first end and a means for attaching to the arrow at a second end, and c. a laser integrated into the arrow tip such that a laser beam is emitted through an aperture at the first end of the arrow tip and substantially coaxial with the arrow.

5. The archery projectile of claim 4 wherein the aperture comprises an optically transparent window.

6. The archery projectile of claim 4 wherein the laser beam passes through a diffractive element integrated into the arrow tip before being emitted from the projectile.

* * * * *